United States Patent [19]

Rusche

[11] 4,045,966

[45] Sept. 6, 1977

[54] CASINGLESS PILE METHOD AND APPARATUS

[76] Inventor: Fredric Rusche, 30303 Beck Road, Wixom, Mich. 48096

[21] Appl. No.: 621,682

[22] Filed: Oct. 14, 1975

[51] Int. Cl.[2] ..... E02D 5/36

[52] U.S. Cl. ..... 61/53.64; 61/53.5; 61/53.52

[58] Field of Search ..... 61/53.64, 53.66, 53.6, 61/53.5, 53.58, 53.62; 52/163, 164, 165

[56] References Cited

U.S. PATENT DOCUMENTS

| | | | |
|---|---|---|---|
| 2,071,047 | 2/1937 | Smith | 61/53.64 |
| 2,162,108 | 6/1939 | Newman | 61/53.64 X |
| 3,141,534 | 7/1964 | Dunston | 52/165 X |
| 3,164,963 | 1/1965 | Talley et al. | 61/53.66 |
| 3,164,964 | 1/1965 | Josephson | 61/53.68 X |
| 3,209,546 | 10/1965 | Lawton | 61/53.68 X |
| 3,303,244 | 2/1967 | Talley et al. | 61/53.66 X |
| 3,324,665 | 6/1967 | Robichaux et al. | 61/53.68 |
| 3,434,294 | 3/1969 | Hall | 61/53.64 X |

FOREIGN PATENT DOCUMENTS

| | | | |
|---|---|---|---|
| 630,256 | 5/1936 | Germany | 61/53.6 |
| 2,029,358 | 6/1970 | Germany | 61/53.64 |
| 1,052,607 | 12/1966 | United Kingdom | 61/105 |
| 1,328,159 | 8/1973 | United Kingdom | 61/53.6 |
| 1,016,350 | 1/1966 | United Kingdom | 61/53.64 |

*Primary Examiner*—Dennis L. Taylor

[57] ABSTRACT

After a hole has been wet-drilled with mud left in, a hollow mandrel with an inflatable bladder is inserted into the bottom of the hole. The bladder is inflated so as to seal against the sides of the hole and concrete is pumped into the hole below the bladder seal to force the mandrel with the inflated bladder thereon upwardly through the hole.

5 Claims, 9 Drawing Figures

CASINGLESS PILE METHOD AND APPARATUS

FIELD OF INVENTION

Hydraulic And Earth Engineering, Stable Structures In Shifting Media, Piles, Casting in situ hardenable fluent material, Dispensing fluent material while withdrawing dispenser.

PRIOR ART

Thornley et al. U.S. Pat. No. 1,831,209; Burrell U.S.-Pat. No. 2,830,443.

BACKGROUND AND OBJECTS

The recent rapidly inflating cost of many construction materials, notably steel pipe, has made it mandatory that an economical, sound, substantial and reliable method be found to install a casingless pile so that the rising cost of foundation work does not make the end cost of many projects prohibitive.

Hertofore, casingless concrete piles have usually been installed by two basic methods.

In the first method, a hole is drilled into the ground to a predetermined depth, using an earth auger. Then, depending upon the diameter of the hole, the shear strength of the soil and the gound water conditions, a casing or metal sleeve may or may not be inserted into the hole to prevent a soil cave-in and ground water infiltration. After this is done, the hole is filled with concrete. Then the casing may or may not be withdrawn as job conditions and specifications dictate.

Normally, piles or caissons are required because of unsuitable soil conditions, so usually a casing is required for each hole. This method is satisfactorily used for casisson 30 inches and larger in diameter where it is possible for a man to enter the caisson for cleanup work, and where the protected hole can be satisfactorily pumped.

However, in the smaller sizes, the system is uneconomical inasmuch as it takes approximately as long to dry auger a small-diameter caisson as it does a large-diameter one, providing drilling equipment is not underpowered. If the smaller hole cannot be satisfactorily pumped, then the pile must be poured by conventional tremie which is costly and time consuming. Also, under these conditions, it is virtually impossible to determine whether or not suitably bearing strata has been reached.

In the second method, a hollow-stemmed type of auger drill is screwed into the ground to a predetermined depth or torque, and a very fluid grout is pumped down the hollow stem to form the pile as the auger is withdrawn.

There are two basic variations employed in this second method and each has many inherent disadvantages, and often times neither method will produce a quality installation.

In the first of these basic methods, an attempt was made to maintain a seal at the periphery of the pile by not rotating the auger as it was withdrawn. This results in a very large force being needed to extract the auger and the entrapped soil from the hole, especially in granular materials. This is caused largely by the truncated cone of earth, often times extending from near the auger bit to a very large diameter circle of earth at the surface of the ground. Depending upon soil conditions, the base of the cone, for a 40 foot, 16 inch diameter pile, could be roughly 20 feet in diameter at the surface in granular material. In fact, it is this theory that prevails in using short-auger anchors to hold down trailers, etc., against hurricane forces in the Florida area.

In the second basic method used in installing the auger cast pile, the auger is turned as it is withdrawn from the hole and where ground water is present under pressure, often times the seal is lost and water may infiltrate into the grout and up along the sides of the pile. Piles of this nature have been uncovered where the pile was only partially set up and rivulets of sand and water extended vertically throughout the pile. These rivulets were caused by medium to high pressure ground water infiltration of the pile during the installation procedure.

Both of these basic concepts were derived during a time when auger cast piles were relatively short in length, that is 40 feet or less, and lightly loaded in the 20 to 40-ton range. Further, the cement grout being pumped down the hollow auger stem was not chosen because of its inherent acceptability, but because it was the only economical material that could be pumped down the small-diameter hollow auger stem that would not freeze up intransit through the stem.

Auger cast installations have been uncovered where the installed piles had a cemented outer shell approximately 1 inch thick, but where the inner core was still a sand, cement, and water slurry. In these cases, in order to maintain the flowability of the grout through the small-diameter hoses and stem, the water-cement ratio had been set so high that the material would not "set up." After the installation was made, the shell around the pile had "set up" becuase the surrounding soil had pulled enough water from the perimeter of the mix so that the mix could hydrate and become concrete.

Other methods have been devised. In Thornley et al. (supra) an expansible packing ring is provided around a base member through which concrete is pumped into the bottom of a hole. Burrell used an expansible mandrel through which concrete was pumped into the bottom of a shell. An expansible sleeve sealed between the mandrel and shell. This, however, was not a casingless pile.

None of the methods of installation presently being used for caseless piles can satisfy all of the parameters necessary to a good sound economical casingless pile installation.

These parameters can be defined, briefly, as follows:

1. Maintenance of the drilled diameter of the hole without the influx of water or soil cave-in during and after the drilling operation.
2. Assurance that the pile is seated into a good load bearing material.
3. Placement of high-strength, low slump concrete without segregation.
4. Prevention of the inter-mixing of concrete and soil during concrete placement.
5. Positive means of assuring continuous pressure in uninterrupted flow between the lower end of the concrete placement tube and the upper face of the concrete.
6. Speed and economy of installation.

It is the object of this invention to provide a method and means for casting piles in situ that is an improvement upon the present art and will satisfy the parameters outlined above.

These and other objects will be apparent from the following specification and drawings, in which.

Figures 1, 2, 3, 4, 5:
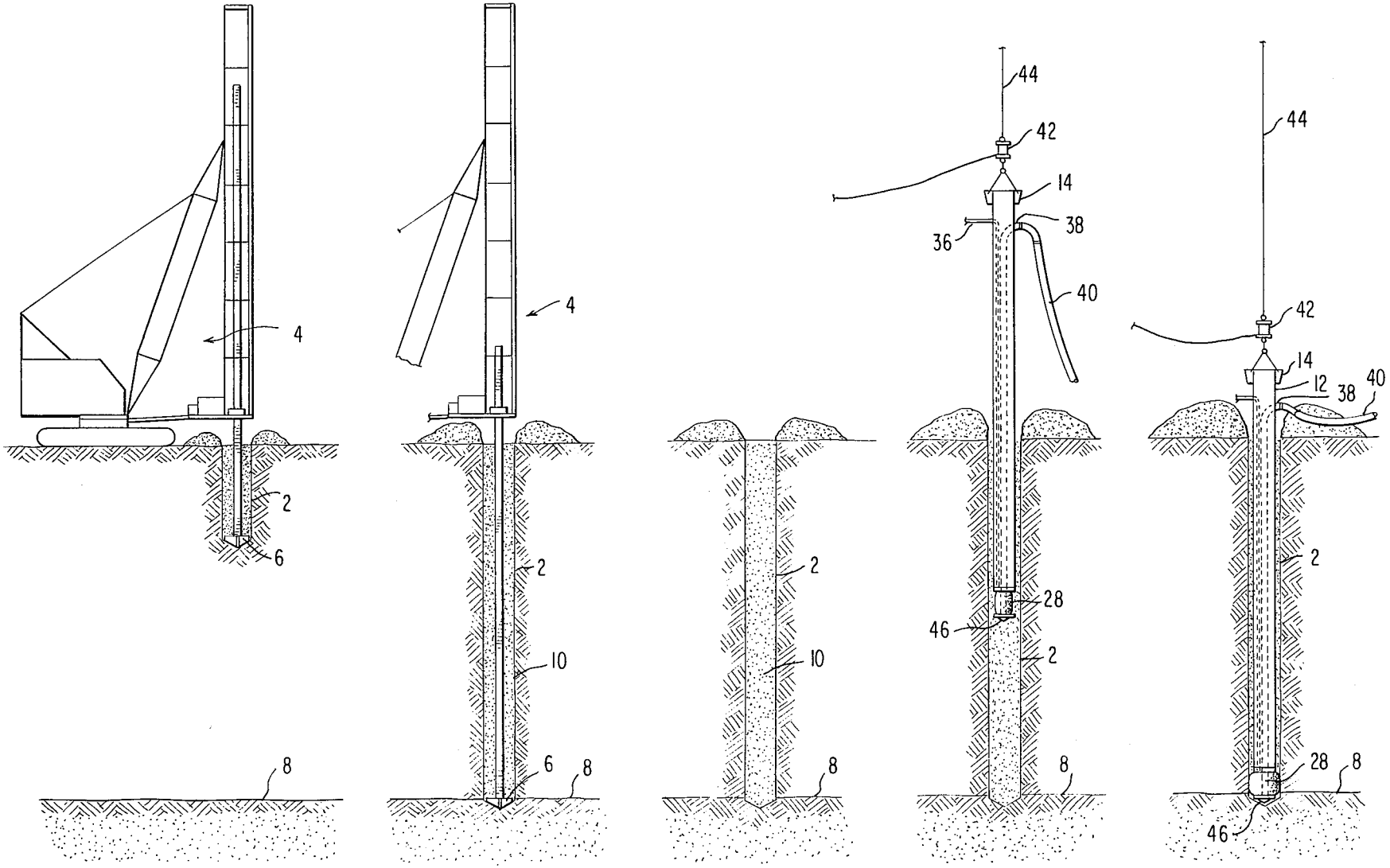
FIGS. 1, 2 and 3 are diagrammatic cross-sections illustrating the fluid rotary-drilling steps in pre-drilling the hole.
FIG. 4 shows the hollow mandrel with an inflatable bladder on the lower end, hollow pipe through the center of the mandrel for transporting the concrete to the pre-drilled hole, being installed as a unit in the pre-drilled hole.
FIG. 5 shows the mandrel fully seated in the hole.

Referring now to the drawings, FIG. 1 shows a hole 2 partly drilled by a high torque power rig 4 which drives a hollow shaft rotary drill bit so as to wet drill the hole to a good bearing strata 8 (FIG. 2). Then the drill is withdrawn, leaving the slurry 10 in the hole.

Depending upon the type and character of the soil being drilled, the fluid means accompanying and aiding the drilling operation can vary greatly. These variations can run from fresh water when drilling in natural on site clays, to fresh water with on site clays plus additives, to fresh water plus bentonite when drilling in granular soils to fresh water plus bentonite and several different additives when drilling in clays and/or granular soils containing contaminates, sulphur water, porosity problems, and swelling problems.

The state of this art is such that practically all soil problems encountered can be compensated for by a skillful drill operator. The infiltration of ground water or artesian water can be eliminated, the side walls of the hole can be prevented from sloughing in, and the loss of circulation fluid can be prevented. As a result, the true diameter of the hole can be obtained and maintained for proper pile installation.

With the variable speed, variable torque, high speed rotary drills which have been developed, it is now possible to literally line the hole on the withdrawal operation to the point where the outer wall of the drilled hole is plastered with a stiff colloidal or bentonite slurry.

The basic functions of the drilling mud as they relate particularly to this invention, are as follows:

1. To prevent water or gas from entering the drilled hole.
2. To "wall up" the bored hole to prevent sluffing during and after the continuous drilling operation.
3. To carry the cuttings out of the hole.
4. To cool the bit.
5. To facilitate the removal of the drill stem and to provide lubricity for the rapid insertion of the concreting mandrel.

Although mud mechanics is a rather complicated subject in its entirety when applied to oil field drilling techniques, the relatively shallow depths of 125 to 150 foot maximum required for deep foundation installation allows experienced drilling foremen, basically skilled in the drilling art but without technical background, to formulate correct mud mixes through the use of a few simple tools.

If, when seeking to find the mud density of a given mix, weight-per-unit volume is considered as density, then weighing the mud on the mud balance (calibrated in pounds per gallon and pounds per cubic foot) affords an easy way of obtaining the correct mud density for a particular soil condition. In order to drill to the maximum 150 foot depth, heretofore mentioned, for the various types of soil encountered in this country, the mud should weight from 8 pounds per gallon to 11 pounds per gallon maximum to suit all pressure conditions.

The wall building property of the mud can be checked on a low pressure filter press, and improved by additives such as finely ground nut shells, finely shredded paper, chemicals etc., all commerically available.

Sand content of the mud must be known to guard against sand deposition in the bottom of the hole. This can be checked by a sand content set and improved, if necessary, by additional mud in the slurry.

In general, the natural clay found on a given site can, almost without exception, be used for what is considered this surface drilling operation. These clays usually require the addition of large amounts of water to keep weight and viscosity within the desired ranges.

When drilling under difficult conditions at these relatively shallow depths, muds treated with soluble calcium salts are sometimes used. These "lime muds" (slaked lime) have excellent stability, good contamination resistance and remain inherently fluid. In the depths being considered here, they will handle almost all problems encountered except for sulphur water. When sulphur water is encountered, it can be compensated for by chemical additives.

These lime muds have the ability to remain quiescent for long periods of time without gelling, and they are ideally suited for casingless pile installations, if needed.

Likewise, bentonite added to the natural clays of the site may be used with good results if the natural clays are settling out of the drilling fluid (a precipitation problem). The use of bentonite in all granular materials is mandatory. They are usually mixed in a 4 to 6 percent flurry with the drilling water. The mixing is done with a hydraulic mixer. If recirculation is lost in granular soils due to the porosity of the surrounding soil, lime and caustic soda may be added to correct the condition.

The high speed and inversely variable high torque drills produced can easily and quickly drill to, or through, all soil formations capable of sustaining high capacity caseless piles (up to 250-ton capacity). Combining this ability with the mud technology, explained above, it is possible now to produce a pre-drilled hole economically, and with good dimensional stability.

Once the stable mud-filled hole has been drilled in accordance with the above techniques, it is ready to become a concrete pile.

Figure 9:
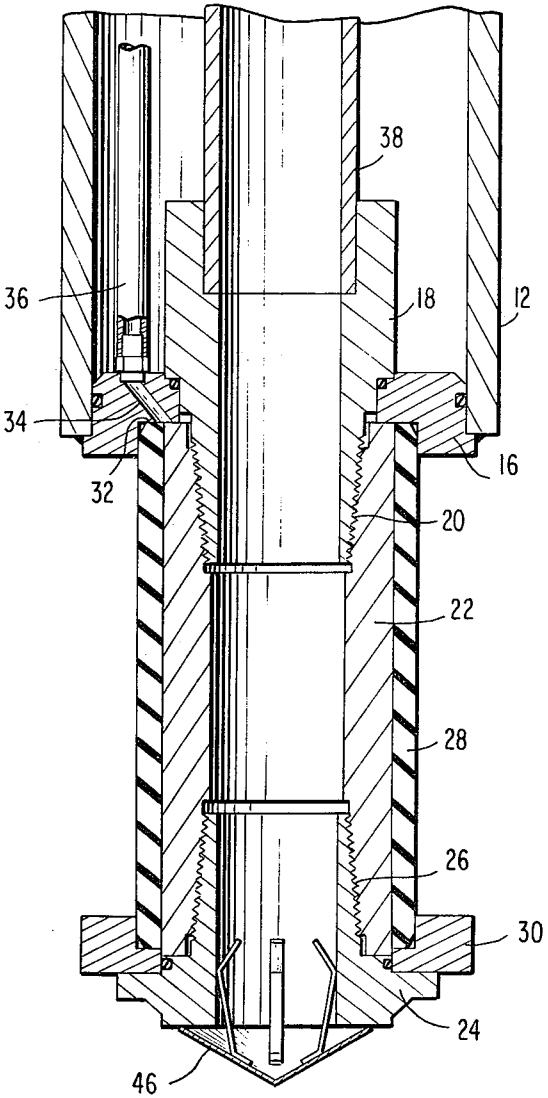
Figure 8:
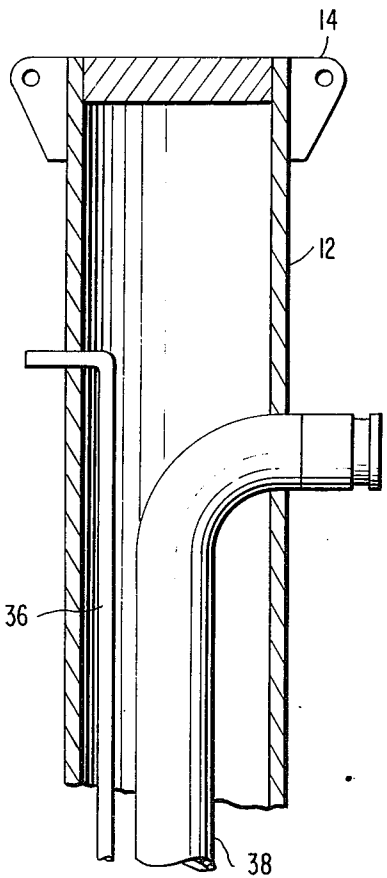
FIG. 8 is a fragmentary elevation of the mandrel showing the inflatable bladder in the deflated position and showing the upper portion of the mandrel; and, FIG. 9 is a fragmentary elevation of the mandrel showing the inflatable portion of the mandrel in the inflated position.
Figure 7:
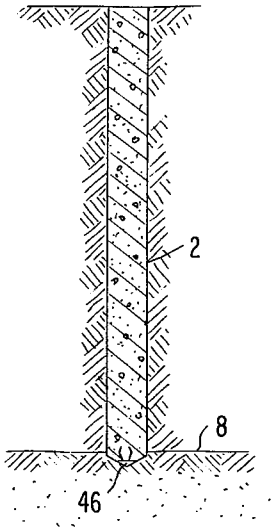
FIG. 7 shows the completed pile.

The foregoing describes the state of the art of wet drilling. The following describes the invention:

Referring particularly to FIGS. 8 and 9, there is dislocsed a mandrel which, by way of example, has an outside diameter of 12 inches and a length of 56 feet. The mandrel 12 has ears 14 at the top for connection to a hoist as described hereinafter. In the bottom of the mandrel is welded a collar 16 and in the collar is secured a coupling 18 under which is threaded, as at 20, a sleeve 22. A nozzle 24 is threaded as at 26 to the lower end of the sleeve. Surrounding tube 22 is an inflatable bladder 28 which, when deflated, is cylindrical. Its lower end is restrained against expansion by a pressure plate 30 and its upper end is restrained against expansion by collar 16 which has a recess 32 in which the upper end of the bladder engages. A suitable sealing compound is used to anchor the lower and upper ends of the bladder to pressure plate 30 and collar 16.

Figure 6:
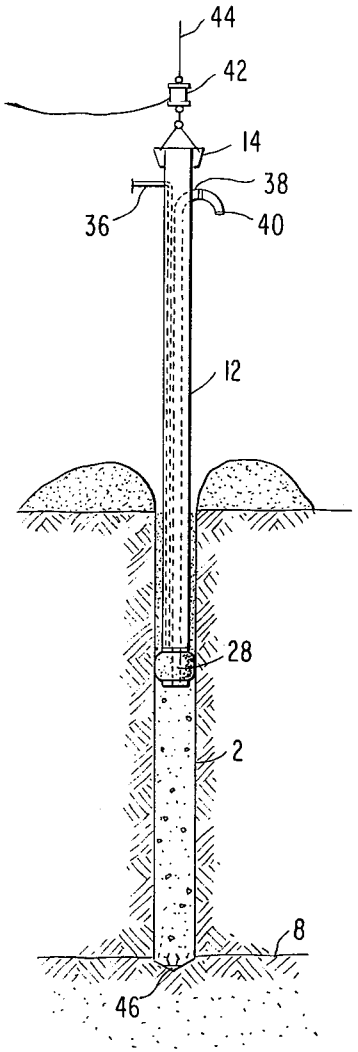
FIG. 6 shows the mandrel as it is being withdrawn from the hole during the concreting operation.

An air conduit 34 connects air pipe 36 to the crack between the bladder 28 and sleeve 22 so that when air under pressure from a source (not shown) is fed to the upper end of air pipe 36, bladder 28 expands to its condition illustrated in FIGS. 5 and 6. A concrete tube 38 running down the middle of the mandrel is connected by a hose 40 to a source of concrete under pressure so that when the concrete is pumped down the tube 38, it flows through coupling 18, sleeve 22 and out the lower end of nozzle 24.

A loose-fitting bottom closure cap 46 is engaged into nozzle 24 by spring fingers so as to prevent entry of the slurry into the nozzle and concrete pipe when the mandrel is being lowered or dropped into the hole.

The above described mandrel, with its bladder 28 deflated, is lowered into the bottom of pre-drilled hole, as illustrated in FIG. 5, and then, depending upon the desired capacity of the pile, the mandrel can be raised to predetermined distance and dropped. The height of the drop can be predetermined by an empirical formula, such as a modified Engineering News Record Formula to predetermined pile capacity. The lubricity of the drilling fluid will, to a large extent, eliminate the soil friction on the periphery of the mandrel during this operation. Dropping the mandrel into the bottom of the hole seats it.

For purposes of analysis, let it be assumed that the pre-drilled hole is 14 inches in diameter and 50 feet in depth. For this hole, the mandrel previously described is 12 inches in diameter and is sixty feet in length. Let is be assumed that the concrete is being pumped from a 4 inch diameter pumper with a capacity of 100 cubic yards per hour at 200 pounds pressure on the concrete. This 200 pound pressure on the concrete basically represents line loss in pumping against a free face.

The 50 foot, 14 inch diameter hole will hold approximately 1.98 cubic yards of concrete. At the designated rate of pumping of 100 cubic yards per hour, the pile will take 1.19 minutes for completion after the start of the pumping operation which gives the mandrel a withdrawal rate of 42 feet per minute. By using a tachometer on the hoist drum for the mandrel, and knowing the drum diameter for a given crane, the rpm's of the drum can be accurately computed for each layer of cable on the drum in order to "tach" the correct 42 foot per minute withdrawal.

During the time the mandrel is being raised to properly seat it in the hole for each individual pile being poured, the frictional resistance of the mud slurry, combined with any other frictional forces involved, can be observed from the gauge of load cell 42 to which the hoisting cable 44 is attached. Assume, for purposes of analysis, that the load cell reads 30,000 pounds when the mandrel is raised prior to dropping at a rate of 42 feet per minute. After the mandrel has been properly dropped and the bladder has been inflated, the concreting operation is ready to begin. Air is pumped in via air tube 36 to inflate the bladder (FIG. 5) and the bladder, with its large contact area, along with protective help from pressure plate 30, is able to maintain a seal against the well plastered side of the hole, and the low slump concrete is unable to penetrate and break the seal if operated within a wide range of reasonable pressure. A pocket of trapped slurry forms between the pressure plate 30 and the lower end of the area of contact between the inflated bladder and the side of the hole.

Then, as the concreting operations begin, we will place sufficient additional pressure on the concrete pump to provide 150 pounds of pressure on every square inch of pressure plate or ring 30 for a total of about 16,950 pounds of concrete pressure tending to lift the mandrel out of the hole. Thereafter, as the mandrel is withdrawn at a rate of 42 feet per minute, the load cell should read about 13,000 pounds line pull off the hoist line. If this drops to, for example, 11,000 pounts, it is an indication that the concrete is being deposited at full pressure and also that there is sufficient pressure under the pressure plate to insure a well-formed pile.

As the bottom of the mandrel nears the surface, the load cell reading can be increased to a full 13,000 pounds of line pull, so that blow-out of the concrete against the small wedge of surface soil does not occur. Then if the hole is over filled by a foot or so and screeded off, any contaminated material located in the pocket above pressure plate 30 can be pushed out so that it does not contaminate the finished pile. After concreting, reinforcing dowels can be placed if desired.

The combination of mandrel weights, concrete pressures and load cell readings can be combined in various workable combinations, but each separate combination must provide a condition whereby a strong positive pressure is maintained between the concrete being deposited and the pressure plate or ring 30 so that a high-density, unsegregated pile is formed. In short, the pressure under the pressure plate should be sufficiently high that a good quality pile is produced and yet not so high that a blow-out into the soil occurs.

Various modifications and additions may be utilized. For example, if desired, the pressure plate 30 may be raked to suit the contour of the bottom of the drill bit.

I claim:

1.

A mandrel for forming in situ a casingless pile, comprising, an elongate hollow tubular mandrel having a lower end portion with an outer wall portion adapted to engage the sides of a bore hole and having an inflatable bladder surrounding the mandrel below said outer wall portion, a nozzle below the bladder, an air pipe for supplying air under pressure to the bladder, a conduit for supplying concrete under pressure to the nozzle, said inflatable bladder comprising an elastomeric band surrounding said mandrel below said outer wall portion, and a rigid annular pressure plate between said band and said nozzle for protecting the lower end of said band when the mandrel is inserted in a bore hole, the diameter of said band, when deflated, being less than the diameter of said outer wall portion, said band being inflatable to a larger diameter than said outer wall portion.

2. A mandrel as claimed in claim 1, wherein the pressure plate is of larger diameter than the bladder in uninflated condition and smaller than the diameter of the bladder in inflated condition.

3. A method of forming in situ a casingless pile, comprising wet-drilling a hole into the ground, seating a mandrel into the bottom of the hole, forming a seal between the lower portion of the mandrel and the side of the hole, pumping concrete under pressure through the mandrel into the hole below the seal while applying an upwardly pulling force to the mandrel until the latter is lifted from the hole and the latter is substantially filled with concrete and correlating the sealing, pumping and pulling forces so as to maintain a predetermined pressure on the concrete in the hole.

4. The method of forcing in situ a casingless pile, comprising wet-drilling a hole into the earth down to a bearing strata, seating a mandrel into the bottom of the hole, sealing the lower portion of the mandrel against the side of the hole by engaging a surface against the hole side by fluid force applied between the mandrel and the surface, applying one lifting force to the mandrel hydraulically by pumping concrete under pressure through the mandrel into the hole below the seal so as to fill the hole below the seal with concrete while applying another lifting force mechanically to the mandrel, and maintaining a relationship between the sealing force and the lifting forces so as to maintain the concrete forced into the hole under predetermined pressure as the mandrel is lifted upwardly.

5. The method as claimed in claim 4, wherein the other lifting force to the mandrel is applied by a hoist producing a predetermined rate of mandrel ascent.

* * * * *